United States Patent [19]

Inoue et al.

[11] 4,347,651

[45] Sep. 7, 1982

[54] SYSTEM FOR MANUFACTURING CONNECTION WIRES

[75] Inventors: Takayuki Inoue; Tatsuya Iwasa, both of Amagasaki, Japan

[73] Assignee: Mitsubishi Denki Kabushiki Kaisha, Tokyo, Japan

[21] Appl. No.: 168,242

[22] Filed: Jul. 10, 1980

[30] Foreign Application Priority Data

Jul. 18, 1979 [JP] Japan ..... 54-92440

[51] Int. Cl.[3] ..... H01R 43/00

[52] U.S. Cl. ..... 29/33 M; 29/564.2; 29/564.6; 29/742; 29/748

[58] Field of Search ..... 29/33 M, 33 K, 33 J, 29/33 F, 564.1, 564.2, 564.6, 742, 748

[56] References Cited

U.S. PATENT DOCUMENTS 3,465,409 9/1969 Brosseit ..... 29/563

3,516,157 6/1970 Brown ..... 29/564.6 X

*Primary Examiner*—Z. R. Bilinsky

*Attorney, Agent, or Firm*—Oblon, Fisher, Spivak, McClelland & Maier

[57] ABSTRACT

A connection wire manufacturing system is provided in which a number of pairs of press-connecting terminals are formed in a hoop material, each being coupled at the heads with each other, and the hoop material with the pairs of press-connecting terminals is transferred to a press-connecting step where those pairs of terminals are separated into individual pairs of terminals and those individual ones are press-connected to connection wires with given lengths properly prepared into a continuous connection wire line which is allowed to be taken up by a take-up drum.

1 Claim, 7 Drawing Figures

SYSTEM FOR MANUFACTURING CONNECTION WIRES

BACKGROUND OF THE INVENTION

The present invention relates to a system for manufacturing connection wires and, more particularly, to a system for manufacturing connection wires to interconnect devices in an electric control board, a switch board, a distribution board and the like.

Connection wires manufactured by a conventional connection-wire manufacturing system are terminated at the respective terminals by press-connecting terminals 2 and marked with wire connecting information, like connection wires 1A to 1C, and those are connected by connecting pieces 4, as shown in FIG. 1. In those wire connecting information 3A to 3C, 3A designates a wire number; 3B a connecting device position; 3C the terminal number of the connecting device.

It is a common practice that the wire connecting the devices in an electric control board is marked at the wire terminal with the line number and the other information before it is connected to the press-connecting terminals. In manufacturing a connection wire line having a number of the connection wires with the same length and the same mark connected at both ends to the press-connecting terminals with the same shape and the same size, various automatic systems for previously manufacturing the connection wires are available on the market. Such connection wires are effective when the same type of the wire conductors are produced on the mass-production basis. However, many electric control boards are generally tailor-made, so that the connection wires usually manufactured have different lengths, different marked designations and different shapes of the press-connecting terminals. In this respect, the above-mentioned automatic system is inappropriate. Also, since the terminal-processed connection wires are individually separated. Therefore, it is troublesome and time-consuming work to take out the connection wires necessary for storing, handling and sorting the wires when those are connected. To solve this problem, there is an approach to manufacture and arrange the connection wires in an inverse direction to that of the wire connecting work, to connect the terminal end of the n-th wire to the starting end of the (n+1)-th wire after the respective ends of the wires are press-connected to the press-connecting terminals, and to wind the connected one around a drum. This approach forms a single connection-wire line with the reverse arrangement of the connection wires by taking account of the succeeding manufacturing processes. This results in easy handling of the wires after the connection, eliminating the need for considering the wiring sequence, minimizing mal-wiring by untrained workers, and providing easier and more efficient wiring, since the wiring job is done simply by pulling out the wires from the drum and by connecting the wires while checking the marks on the wire to identify a connection device position, terminal number, etc. In connection with the terminal process by this approach, the press connecting terminal 2 of the n-th connection wire 1A is connected to the press connecting terminal 2 of the (n+1)-th connection wire by means of a coupling piece 4, as shown in FIG. 1. Subsequently, the (n+1)-th wire is connected to the (n+2)-th terminal in similar manner.

Thus, if the conventional terminals are used, it is necessary to connect the terminals by means of the coupling pieces 4, as shown in FIG. 1. For this reason, the number of terminal selection units for the connection before the terminal is press-connected and the number of press-connecting units for the connection after the press-connection of the terminal, must be the kinds of the terminals used. The structure of the connecting the terminals by the coupling pieces is complicated. Additionally, when the terminals are of the end-open type, it is impossible to connect them by the coupling pieces. In this case, many kinds of the press-connecting terminals must be purchased. This poses problems of storing method and higher cost.

SUMMARY OF THE INVENTION

Accordingly, an object of the invention is to provide an inventive and improved system for manufacturing connection wires with different sizes.

Another object of the invention is to prove a system for manufacturing connection wires with different sizes which provides a single continuous line formed by pairs of press-connecting terminals with different shapes and different sizes, each pair of the terminals being connected at the heads to each other.

To achieve the above object, there is provided a system for manufacturing connection wires with different shapes and sizes comprising: a wire selection/supply unit having a function to hold various types of wires at the terminal and to select necessary wires to manufacture, a tension mechanism to supply wires selected, and a function to feed the selected wire; a wire-length measuring/wire supply unit having a function to feed specified wires in forward and reverse directions, and a function to measue the length of the wire; a marking unit having a function to select characters and signs, which are specified, as wire connection information and marks them on both end portions of each wire; a wire fixed-length/pulling unit having a function to hold and feed the wire by a fixed length; a wire cutting/stripping unit having a function to cut the wire at specified positions and to stripping an insulating cover at both end portions by a specified length for press-connecting with the wire; a press-connecting terminal fabricating/forming unit with two or more sets of terminal fabricating-/forming jigs for supply press-connecting terminals with specified shapes and specified sizes to the end portions of the wires, which the press-connecting terminal fabricating/forming unit has a function to select the jig from those ones in accordance with a direction and to continuously form pairs of the press-connecting terminals with specified shapes and sizes, each being coupled at the heads with each other by a separating portion, in a hoop material as the terminal material; a unit for holding the hoop terminal material to supply the hoop material to the press-connecting terminal fabricating/forming unit; a terminal supply unit having a function to cut the press-connecting terminals fabricated and formed by the press-connecting terminal fabricating/forming unit on a pair-by-pair basis, and to keep the holding of the terminal for transfer to a press-connecting location; a terminal press-connecting unit having a function to press-connect the press-connecting terminal transferred by the supply unit to the given terminal ends of the wire; a wire take-up unit having a tension function and a traverse function for taking up the connection wire manufactured through the respective units by a drum; and a unit which receives from an information medium such as a paper tape or a preset mechanism various information of the connection wire such as type and length of the wire, wire connection, shape and size of the terminal and the like, and issues various operation commands to the respective units; whereby upon application of the operation command to the respective automatic units, a specified wire is taken out and set in said respective units, the wire is marked with wire connecting information and the like, the wire is cut into a given length of the wire, insulating cover at the terminal ends of the wire is stripped, the pair of the press-connecting terminals with specified shapes and sizes, being coupled at the heads with each other by the separating portion, are press-connected to the connection wire with the terminal ends processed in the insulating cover stripping, thereby to connect the connection wires, and the wires once cut by the given length are again connected by the terminal portions thereby to be wound around the drum while those are coupled with one another, whereby the connection wires are connected in a continuous manner.

Other objects and features of the invention will be apparent from the following description taken in connection with the accompanying drawings, in which:

DETAILED DESCRIPTION OF THE PREFERRED EMBODIMENTS

Figure 1:
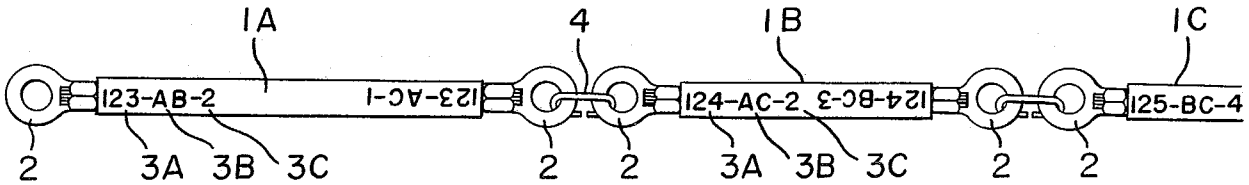
FIG. 1 PRIOR ART
FIG. 1 shows a plan view of a part of connection wires connected by a conventional connection method of the connection wires.
Figure 3:
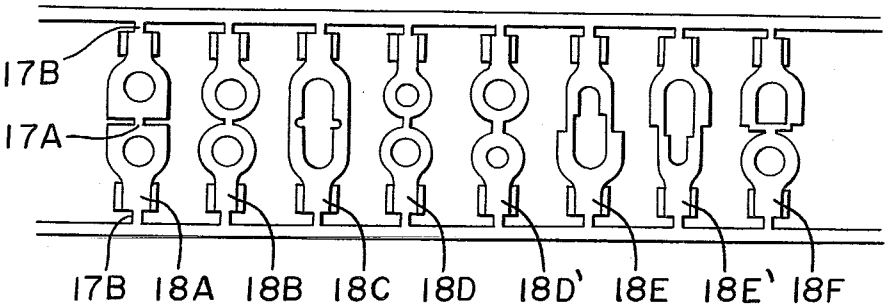
FIG. 3 is a plan view of a part of press-connecting terminals fabricated and formed by a terminal fabricating/forming unit used in the manufacturing unit according to the present invention.
Figure 2:
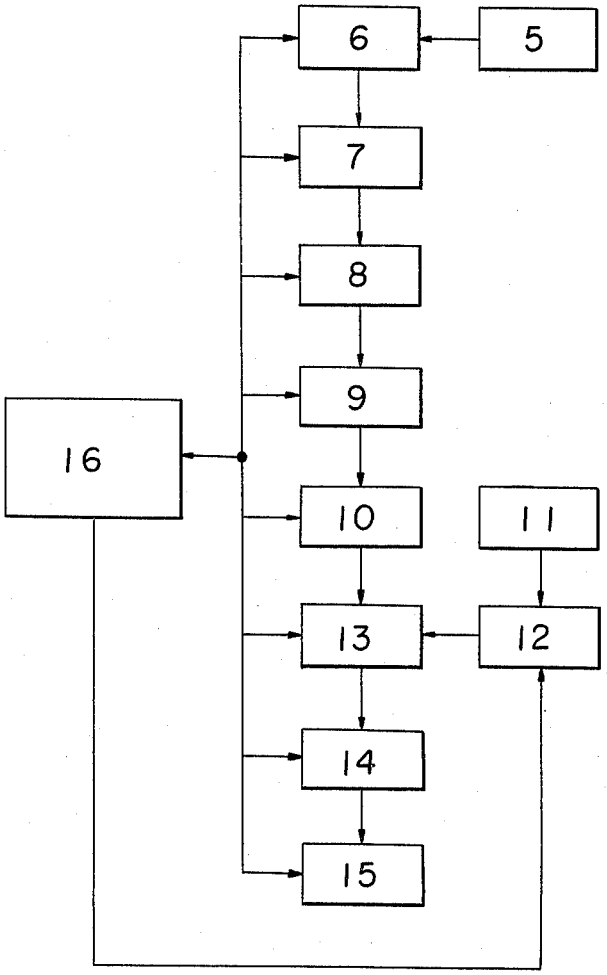
FIG. 2 illustrates in block form an embodiment of a connection wire manufacturing system according to the present invention.

A preferred embodiment of the present invention will be described hereinafter with reference to the accompanying drawings. In FIG. 2, reference numeral 5 designates a group of connection wires with different colors and sizes which are necessary in manufacturing the connection wires. A wire selection/supply unit 6 selects a necessary wire from the group of the connection wires 5 and feeds it to a wire length measuring/supply unit 7. The wire length measuring/supply unit 7 measures a necessary length of the selected wire and feeds in turn it to next step of the wire manufacturing process. A marking unit for directly marking on the wires wiring information necessary for a wiring and connecting work of the wires. A fixed-length pulling unit 9 pulls by a fixed-length the marked wire by clamping it so as not to dislocate the mark on the wire from the correct marked position and sets the wire so that a cutting position of the wire is positioned at the center of a cutting/stripping unit 10. 11 is a hoop material for a press-connecting terminal. A press-connecting terminal forming unit 12, which has two or more sets of fabricating/forming jigs to produce necessary press-connecting terminals, forms the press-connecting terminals with given size and shape from the hoop material as the terminal material by selecting a suitable jig from those jig under the direction by a control unit 16. A terminal supply unit 13 cuts the press-connecting terminal formed with the given shape and size from those formed, and supply it to a press-connecting location while holding it. A press-connecting unit 14 presses given press-connecting terminals to connect them to the connection wire and strip an insulating cover of the wire by a given length from the end portions of the wire. A wire take-up unit 15, having a tension mechanism and a traverse mechanism, continuously takes up a connection-wire line having a number of the wires terminal-processed and connected. The control unit 16 provides necessary commands to the above-mentioned respective units on the basis of the information received from an information medium such as a paper tape or the like, or a preset mechanism the information on the wire type and length, wiring information to be marked, and the information on the terminal size and shape. FIG. 3 shows a set of terminals with different sizes and shapes which are, integrally coupled with one another, formed in a sheet of hoop material by the use of the terminal forming unit used in a terminal manufacturing system according to the present invention. In the figure, 18A designates a pair of square press-counting terminals with the same size. 18B is a pair of circular terminals with the same size. 18C is a pair of end-open terminals with the same size. 18D and 18D' are pairs of circular terminals with different terminals, respectively. 18E and 18E' are pairs of end-open terminals with different sizes. 18F is a pair of terminals with different shapes. Each of those pairs of terminals at the heads are coupled with each other by means of a separating portion 17A. Those pairs of terminals are coupled with one another by cutting portions 17A in a chain fashion into an integral form of the terminals.

Figure 4:
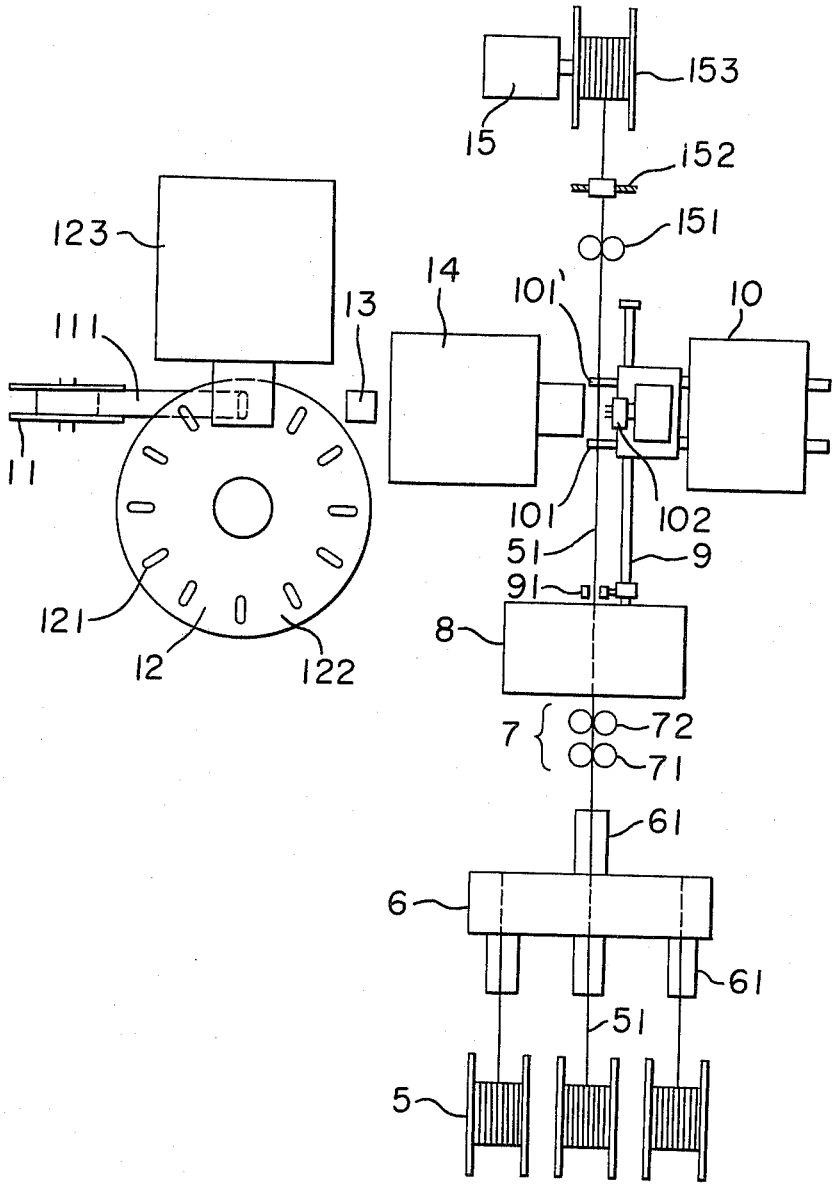
FIG. 4 is a schematic diagram of the manufacturing system according to the invention.
Figure 5:
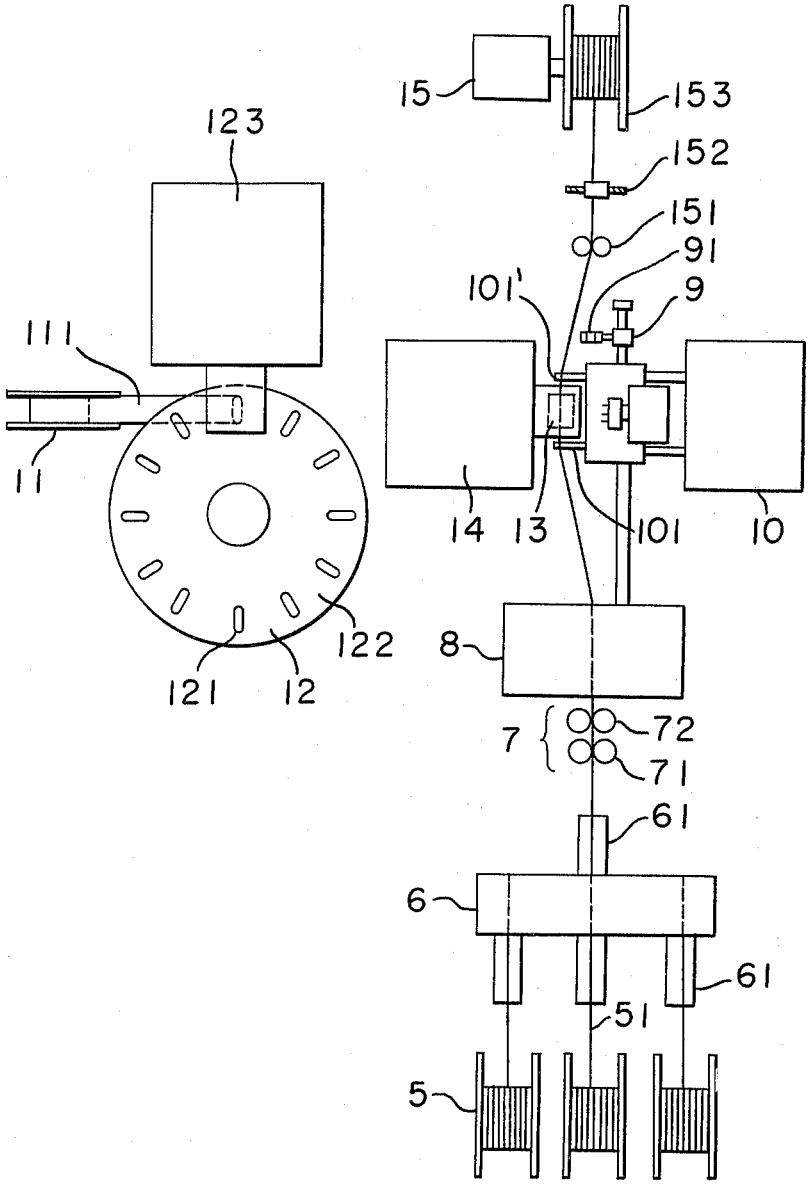
FIG. 5 is a schematic diagram of the manufacturing system shown in FIG. 4, which depicts a state that the press-connection of the terminal is currently made.

The operation of an embodiment of the present invention illustrated in a block form in FIG. 2 will be described referring to FIGS. 4 to 5 which depict in more detail the embodiment in FIG. 2. A group of wires includes wire colors and diameters, which are necessary for manufacturing connection wires. One end of the wires are held by the wire selection/supply unit 6. Upon receipt of a command issued from the control unit 16, the wire selection/supply unit 6 selects a specific wire 51 from the wires held and feeds the specified one to the wire supply unit 7, by way of the tension mechanism 61. The wire fed to the wire supply unit 7 is measured in its length by means of a detector coupled with measuring rollers 71 and then is further fed to the marking unit 8 by feed rollers 72. The wire 51 proceeds by being wound around the drum 153 in good order through the tension mechanism and the traverse mechanism by the use of the winding unit 15 until the specified length of the wire is fed to the specified position of the marking unit 8. While the wire 51 is fed by the specified length, the character selection mechanism of the marking unit 8 selects the necessary character under control of the control unit 16. On completion of the character selection and the wire feed, the marking mechanism marks simultaneously the end with the specified designations. The marked cable 51 is fed so that the cutting position of the n-th and the (n+1)-th cables comes to the center of cutting/stripping unit 10. During the operation, if the roller 72 feeds the wire, it is twisted due to the wire's kink, resulting in no assurance of the mark on the upper side of the wire. This may cause a dislocation of the marking position from the terminal mounting face, and in the worst situation the marking position may come to the position by 180° dislocated from the terminal mounting face, which the mark invisible when it is connected to a terminal of a related apparatus. It is for this reason that the marked wire is held by the clamping unit 91 of the fixed length pulling unit and pulled by a certain length and that the cut position of the cable comes to the center of the cutting/stripping unit. When clamped by the clamping mechanism 101 and 101', the clamping unit of the fixed length pulling unit 9 is released. Then, a cutting/stripping edge 102 cuts the wire 51 at the cut position as well as cuts the insulation cover by a given length without damaging the conductor. The clamping mechanism 101 and 101' moves to the right and left to strip the insulation cover at the end part.

The parallel with the above operation starting with the wire selection, the terminal forming unit 12 forms the terminal of the size and shape necessary for the wire terminal. A jig 121 that is needed for forming the terminals is held on the turning table 122, which rotates by a given number of turns, in accordance with an instruction from the control unit 16, right under the head of a press 123. After making sure that the hoop material 111 is fed from the hoop material supply unit 11 to the terminal forming unit 12, the press 123 is operated.

Figure 6:
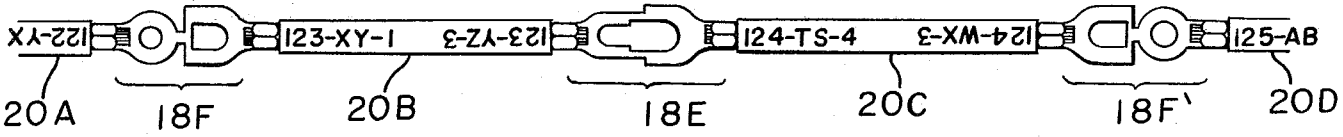
FIG. 6 is a plan view of an example of the connection wires being coupled with one another, which is manufactured by the manufacturing system according to the invention.

Through this operation, the hoop material 11 has, as shown in FIG. 3, terminals formed in which the pairs of the press-connecting terminals coupled at the heads with each other by the separating portions 17A and those pairs of the terminals are connected by the cutting portions 17B into a chain of the pairs of the terminals. The terminal formed by the terminal forming unit 12 is cut at the cutting portion 17B by the cutting unit which operates simultaneously with the press 123 (not shown), and is fed and held to and by the terminal supply unit 13, that is, a feed table. Then the pair of the terminals 18 held on the feed table 13, as shown in FIG. 5, is carried to right under the head of the pressure connecting unit 14. At the same time, the wire 51 of which the insulation cover is stripped at both the ends is moved to the press-connecting jig position of the press-connecting unit while being held by the clamping mechanism 101 and 101'. Under this condition, the press-connecting unit 14 operates to effect the press-connecting of the pressure terminals 18 with the wires. After the press-connecting operation ends, the clamping mechanisms 101 and 101', and 91, and the feed table 13 return to the original position in preparation for the next operation. The connection wires 51 thus connected, having a continuous form with the separating portions 17A connecting the heads of the terminals, as shown in FIG. 6, regardless of the wire length and the wire shapes and sizes, is taken up by a take-up drum 153 through the tension mechanism 151 and the transverse mechanism 152. To take up the wire fed by the wire selection/supply unit 6, the tension mechanism 151 operates and the take-up unit 15 drives the drum 153 to wind the wire therearound. In this case, the wire is measured and supplied by adding or subtracting the wire length pulled by the fixed-length pulling unit 9 to or from the length of the next supply. Therefore, when a shorter wire than the length thereof pulled by the fixed length given by the fixed-length pulling unit is needed, the feed roller 72 operates to feed the wire by a necessary length in the reverse direction. When the next wire is longer than the fixed length of the fixed length feeding unit, the feed roller 72 rotates in the forward direction to feed the wire only by the insufficient length thereof while at the same time by the wire-length measuring roller 71 measures the length of the wire.

In this way, all of the operations such as selection of the wire type required for wiring, measurement and supply of the wire, marking of the wire information, cutting and stripping of the wire at the specified position, forming of the terminals with the required shapes and sizes, press-connecting of the terminals to the ends of the wire, are performed automatically and continuously, and the connection wires manufactured is connected at the terminal parts into a continuous wire and is wound around the drum.

Figure 7:
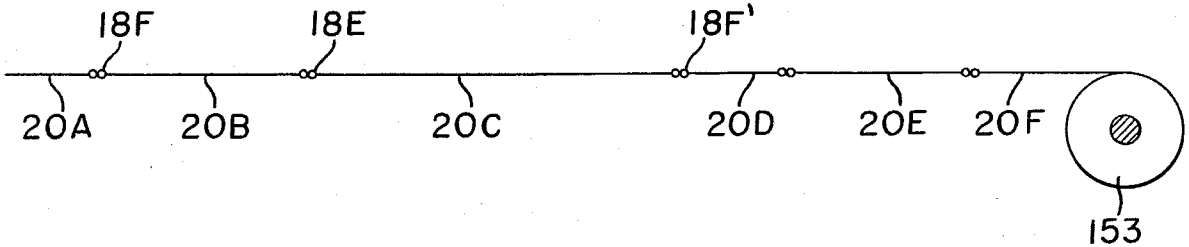
FIG. 7 is a schematic diagram illustrating how to take up a connection wire line by a take-up drum.

FIG. 6 shows a state of a part of the connection wire thus manufactured by the connection wire manufacturing system of the invention prior to being taken up by the drum. For example, wires 20A, 20B, 20C and 20D, are connected by the terminals 18F, 18E and 18F', as shown. The wires 20A, 20B, 20C and 20D thus connected is taken up as a single wire line by the drum 153, as shown in FIG. 7.

While having been described by using a specific embodiment, the present invention may be changed and modified variously.

(1) In the above-mentioned embodiment, the marking unit marks characters directly on the wire. In place of this, a technique to mark necessary characters on a tube and to fit the tube with the characters around the wire, and another technique to select a desired ring mark from those marks and to fit it to the wire, can be employed for the same purpose.

(2) A rotatory table is employed as the hold/selection unit for the terminal forming jig in the above-mentioned embodiment. This may be replaced by a straight moving table where the jigs are arranged straight.

(3) For fabricating and forming the terminals, a terminal forming unit having a forming part and a punching part separately, may also be used.

(4) The two-line arrangement is allowed; the first half includes the wire selection/supply unit, the wire-length measuring unit, and the marking unit, and the latter half line includes the terminal forming unit, the wire cutting/stripping unit, the connecting unit, and the take-up unit.

As seen from the foregoing, the present invention uses an apparatus for fabricating and forming the press-connecting terminals with different shapes and sizes and the pairs of the press-connecting terminals are each coupled at the heads with each other. With such an arrangement, only one press-connecting unit is needed, so that the overall system is simple and less expensive to produce. Various types of terminal need not be purchased and stored. The necessity is the supply of the hoop material, with the result that the material supply is attainable with ease and less cost. Storage of the material requires less space and less cost. In the present invention, the connection wires are coupled into a single wire line. The single wire line includes a number of the connection wires arranged in the reverse order to that of the wiring procedure, and is continuously wound around the drum. This feature makes the wire in storage and transferring. On wiring, not sequence of the wiring must be taken into account and unskilled workers can easily work without trouble of mal-wiring.

We claim:

1. A system for manufacturing connection wires with different shapes and sizes comprising:

a wire selection and supply unit having a function to hold various types of wires at the terminal and to select necessary wires to manufacture, a tension mechanism to supply wires selected, and a function to feed the selected wire; a wire-length measuring and wire supply unit having a function to feed specified wires in forward and reverse directions, and a function to measure the length of the wire; a marking unit having a function to select characters and signs, which are specified, as wire connection information and marks them on both end portions of each wire; a wire fixed-length and pulling unit having a function to hold and feed the wire by a fixed length; a wire cutting and stripping unit having a function to cut the wire at specified positions and to strip an insulating cover at both end portions by a specified length for press-connecting with the wire; a press-connecting terminal fabricating and forming unit with two or more sets of terminal fabricating and forming jigs for supply press-connecting terminals with specified shapes and specified sizes to the end portions of the wires, which press-connecting terminal fabricating and forming unit has a function to select the jig from those ones in accordance with a direction and to continuously form pairs of the press-connecting terminals with specified shapes and sizes, each being coupled at the heads with each other by a separating portion, in a hoop material as the terminal material; a unit for holding the hoop terminal material to supply the hoop material to the press-connecting terminal fabricating and forming unit; a terminal supply unit having a function to cut the press-connecting terminals fabricated and formed by the press-connecting terminal fabricating and forming unit on a pair-by-pair basis, and to keep the holding of the terminal for transfer to a press-connecting location; a terminal press-connecting unit having a function to press-connect the press-connecting terminal transferred by the supply unit to the given terminal ends of the wire; a wire take-up unit having a tension function and a traverse function for taking up the connection wire manufactured through the respective units by a drum; and a unit which receives from an information medium such as a paper tape or a preset mechanism various information of the connection wire such as type and length of the wire, wire connection, shape and size of the terminal and the like, and issues various operation commands to the respective units; whereby upon application of the operation command to the respective automatic units, a specified wire is taken out and set in said respective units, the wire is marked with connecting information and the like, the wire is cut into a given length of the wire, insulating cover at the terminal ends of the wire is stripped, the pair of the press-connecting terminals with specified shapes and sizes, being coupled at the heads with each other by the separating portion, are press-connected to the connection wire with the terminal ends processed in the insulating cover stripping, thereby to connect the connection wires, and the wires once cut by the given length are again connected by the terminal portions thereby to be wound around the drum while those are coupled with one another, whereby the connection wires are connected in a continuous manner.

* * * * *